US009060573B2

(12) United States Patent
Lin

(10) Patent No.: US 9,060,573 B2
(45) Date of Patent: Jun. 23, 2015

(54) ZIPPER HEAD AND PULL TAB REPLACEMENT METHOD

(71) Applicant: CHUNG CHWAN ENTERPRISE CO., LTD., Tao Yuan Hsien (TW)

(72) Inventor: Yu-Pau Lin, Taoyuan County (TW)

(73) Assignee: CHUNG CHWAN ENTERPRISE CO., LTD., Tao Yuan Hsien (TW)

( * ) Notice: Subject to any disclaimer, the term of this patent is extended or adjusted under 35 U.S.C. 154(b) by 62 days.

(21) Appl. No.: 13/861,386

(22) Filed: Apr. 12, 2013

(65) Prior Publication Data

US 2013/0318751 A1 Dec. 5, 2013

(30) Foreign Application Priority Data

May 29, 2012 (TW) ..... 101119069 A
Sep. 19, 2012 (TW) ..... 101134263 A

(51) Int. Cl.
*A44B 19/30* (2006.01)
*A44B 19/26* (2006.01)
*A44B 19/42* (2006.01)

(52) U.S. Cl.
CPC ..... *A44B 19/262* (2013.01); *Y10T 24/2586* (2015.01); *Y10T 29/49945* (2015.01); *A44B 19/42* (2013.01)

(58) Field of Classification Search
CPC .... A44B 19/262; A44B 19/308; A44B 19/42; Y10T 24/2586; Y10T 24/2566; Y10T 24/257; Y10T 24/2571; Y10T 24/2575; Y10T 24/2577; Y10T 29/49945
USPC ..... 24/429, 420, 421, 422, 423, 424
See application file for complete search history.

(56) References Cited

U.S. PATENT DOCUMENTS

| | | | | | |
|---|---|---|---|---|---|
| 4,123,828 | A * | 11/1978 | Akashi | 24/422 |
| 4,667,376 | A * | 5/1987 | Ishii et al. | 24/421 |
| 4,829,638 | A * | 5/1989 | Ishii | 24/421 |
| 5,068,950 | A * | 12/1991 | Yuki | 24/429 |
| 5,611,121 | A * | 3/1997 | Akeno et al. | 24/423 |
| 5,864,928 | A * | 2/1999 | Matsushima | 24/421 |
| 6,654,988 | B1 | 12/2003 | Chung | |
| 7,219,402 | B2 * | 5/2007 | Yamazaki | 24/429 |
| 7,870,650 | B2 * | 1/2011 | Keyaki et al. | 24/424 |
| 2009/0133232 | A1 | 5/2009 | Sanna | |
| 2009/0313793 | A1 | 12/2009 | Lin | |
| 2010/0186200 | A1 | 7/2010 | Chan | |

FOREIGN PATENT DOCUMENTS

| | | |
|---|---|---|
| CN | 101422288 A | 5/2009 |
| TW | I251476 | 3/2006 |
| TW | M292296 | 6/2006 |
| WO | WO2010058465 A1 | 5/2010 |

* cited by examiner

*Primary Examiner* — Robert J Sandy
*Assistant Examiner* — Abigail Morrell
(74) *Attorney, Agent, or Firm* — Li & Cai Intellectual Property (USA) Office

(57) ABSTRACT

The instant disclosure relates to a zipper head. The zipper head includes a main structure, a flexible member, a securing member, a pull tab, a guiding member, and a shaft. The main structure has a first fixing portion and receives the flexible member. The securing member has a second fixing portion corresponding to the first fixing portion. The securing member contacts with the flexible member. The guiding member is pivotally connected to one end of the main structure and contacts with the securing member. A receiving space is cooperatively defined by the main structure, the securing member, and the guiding member. A fixing end of the pull tab is disposed in the receiving space. The shaft penetrates the main structure and is pivotally connected to the securing member. The instant disclosure also discusses a method for replacing the pull tab of the zipper head.

19 Claims, 8 Drawing Sheets

ZIPPER HEAD AND PULL TAB REPLACEMENT METHOD

BACKGROUND OF THE INVENTION

1. Field of the Invention

The present disclosure relates to a zipper head with a replaceable pull tab and a pull tab replacement method; in particular, to a zipper head structure which can yield a gap for replacing a pull tab and a pull tab replacement method of the same.

2. Description of Related Art

Conventional zipper heads are structures for zipping and unzipping zipper teeth. Due to its convenient operation, the zipper head is widely used on bags and clothing. The principle of zipper lies in: opening and closing the mutually engaging zipper teeth by the back and forth motion of the zipper head.

Conventional zipper heads generally include a main structure, a securing member, a spring, a crown and a pull tab. The securing member is pressed into the guiding groove of the main structure by the spring. One end of the spring is under the securing member. The crown is fixed on the main structure such that the securing member and the spring are positioned inside the crown. For example, TW Publication Number M292296 (Patent Number 95200113) discloses a "zipper head assembly structure (2)".

However, the spring of the above conventional zipper head is fixed onto the main structure by riveting. After the spring is fixed onto the main structure, the securing member and the pull tab are fixed together onto the main body such that the pull tab cannot be replaced. However in practice, downstream manufactures have different needs for pull tabs and often need to replace the same. In particular, some more unique pull tabs are varied and in small quantities, requiring mechanical assembly by hand. Therefore each type of pull tab requires a specific machine for assembly, increasing the cost of manufacturing.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a zipper head structure with a replaceable pull tab and its pull tab replacement method, so as to allow downstream manufacturers to replace pull tabs without installing assembly machines, thereby reducing the cost of manufacturing.

In order to achieve the aforementioned objects, the present disclosure provides a zipper head structure with a replaceable pull tab, including: a main structure having a first fixing portion; a flexible member disposed within the main structure; a securing member having a second fixing portion corresponding to the first fixing portion, inserted in the main structure and abutting the flexible member; a pull tab having a fixing end; a guiding member pivotally connected to one end of the main structure and abutting the securing member, wherein the guiding member, the securing member and the main structure define a receiving space, and the fixing end of the pull tab is disposed in the receiving space; and a shaft passing through the main structure and pivotally connected to the securing member.

The present disclosure further provides a pull tab replacement method for a zipper head structure with a replaceable pull tab, including the following steps: provide the mentioned zipper head structure with a replaceable pull tab; when the pull tab is to be pulled out, apply an external force on the pull tab such that the fixing end drives the securing member to rotate about the shaft and increase the receiving space and press against the flexible member; then apply another external force on the guiding member such that the guiding member yields a gap to the receiving space, and the pull tab is pulled out; stop applying force, and the flexible member provides a restoring force to drive the securing member to rotate about the shaft back to the original position, and the securing member in turn drives the guiding member to move back to the original position; and when another pull tab is to be inserted, apply an external force at the fixing end of this pull tab such that the fixing end pushes the guiding member inward to yield the gap, and the guiding member raises the securing member and makes the securing member press against the flexible member; when the fixing end is pushed to an end, stop applying force, the flexible member then provides a restoring force on the securing member such that the securing member drives the guiding member back to the original position.

The present disclosure has the following benefits: the guiding member design of the present disclosure provides a gap on the main structure for pull tabs to move in and out of in a convenient operation, effectively reducing labor and the eliminating the need for a new assembly machine.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
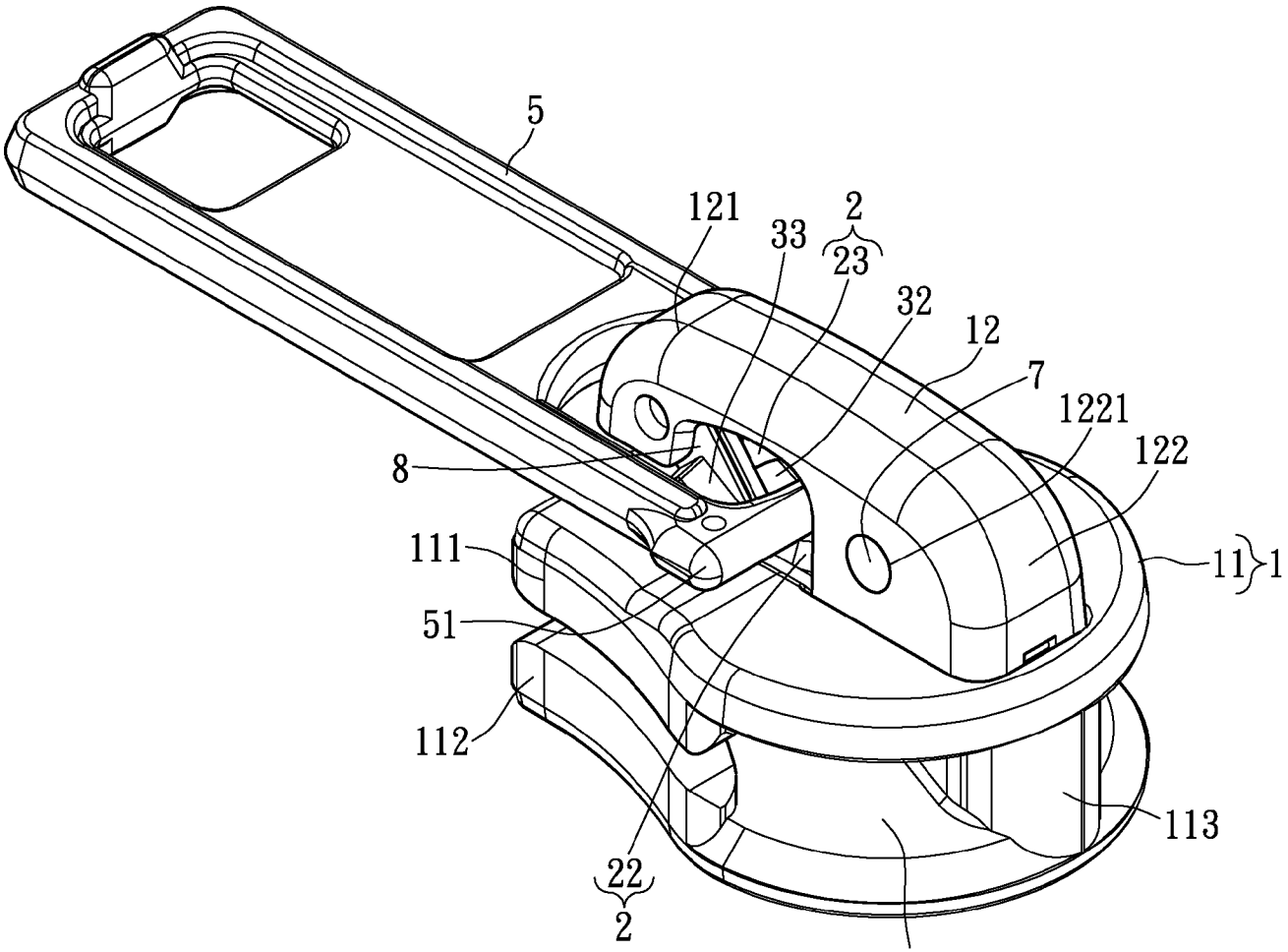
FIG. 1 shows an assembly diagram of a zipper head structure with a replaceable pull tab of the present disclosure.
Figure 2:
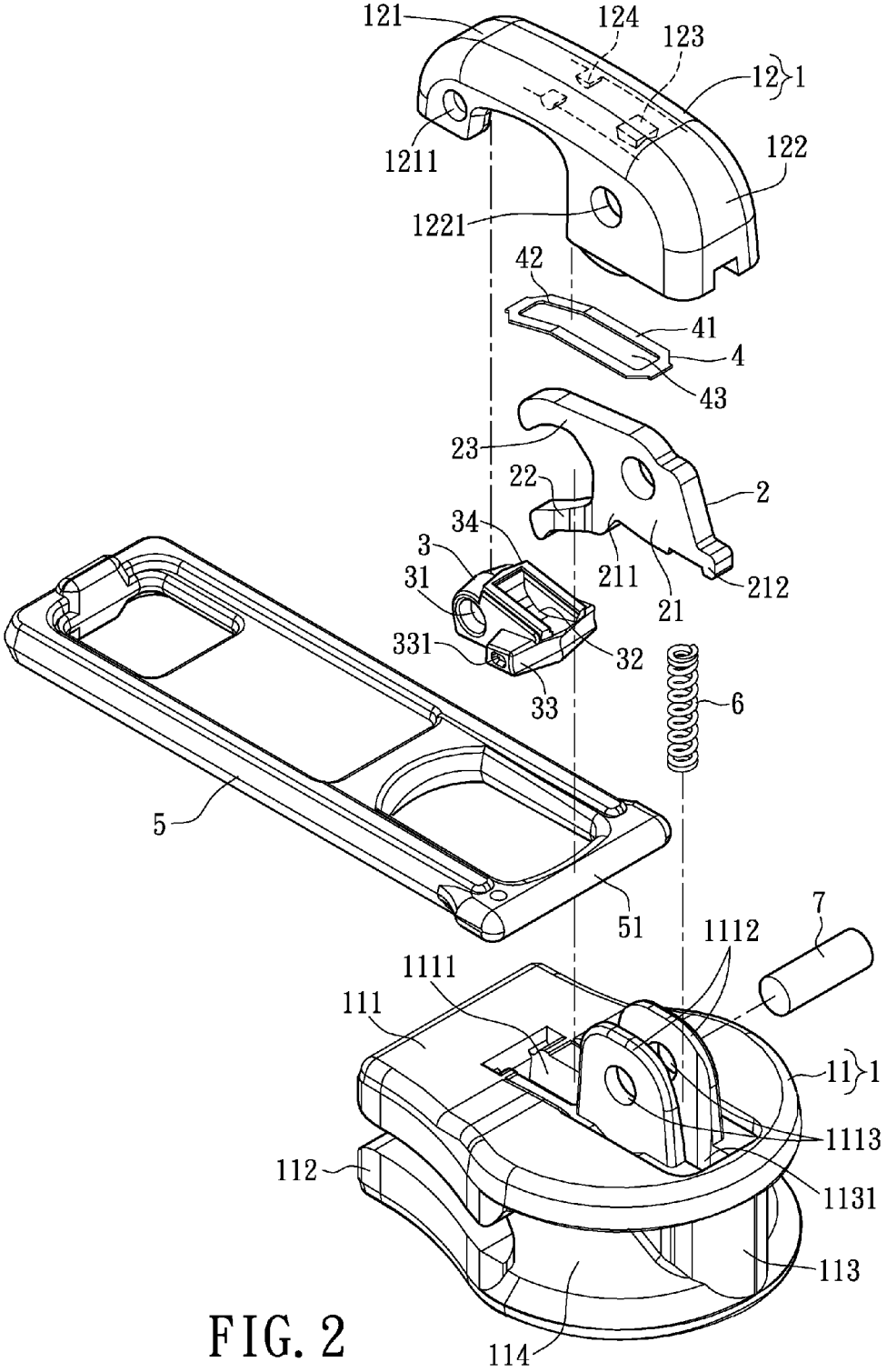
FIG. 2 shows an assembly diagram of a zipper head structure with a replaceable pull tab of the present disclosure.

Referring to FIG. 1 and FIG. 2, the present disclosure provides a zipper head structure with a replaceable pull tab, including a main structure 1, a securing member 2, a guiding member 3, a blocking piece 4, a pull tab 5, a flexible member 6 and a shaft 7. The main structure 1, the securing member 2 and the guiding member 3 jointly define a receiving space 8.

The main structure 1 includes a zipper head 11 and a crown 12. The flexible member 6 is accommodated within the zipper head 11. The securing member 2 is inserted in the zipper head 11 and abuts the flexible member 6. One end of the crown 12 is pivotally connected to the zipper head 11 and the securing member 2 by the shaft 7. The other end of the crown 12 is pivotally connected to the guiding member 3. The blocking piece 4 is disposed within the crown 12 and abuts the zipper head 11 and the guiding member 3. The blocking piece 4 is latched within the receiving space 8.

Figure 3:
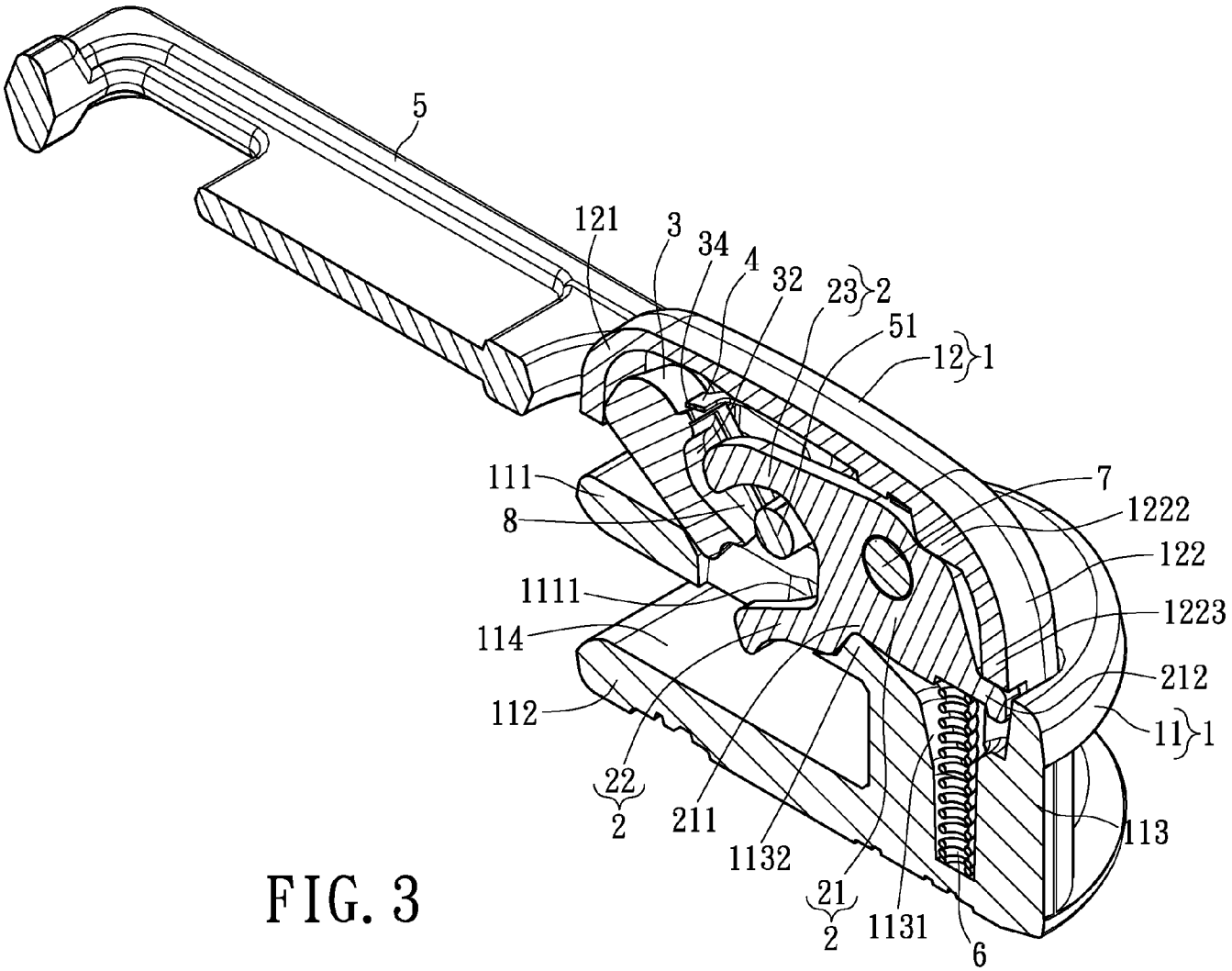
FIG. 3 shows a cross-sectional diagram of a zipper head structure with a replaceable pull tab of the present disclosure (1)
Figure 4:
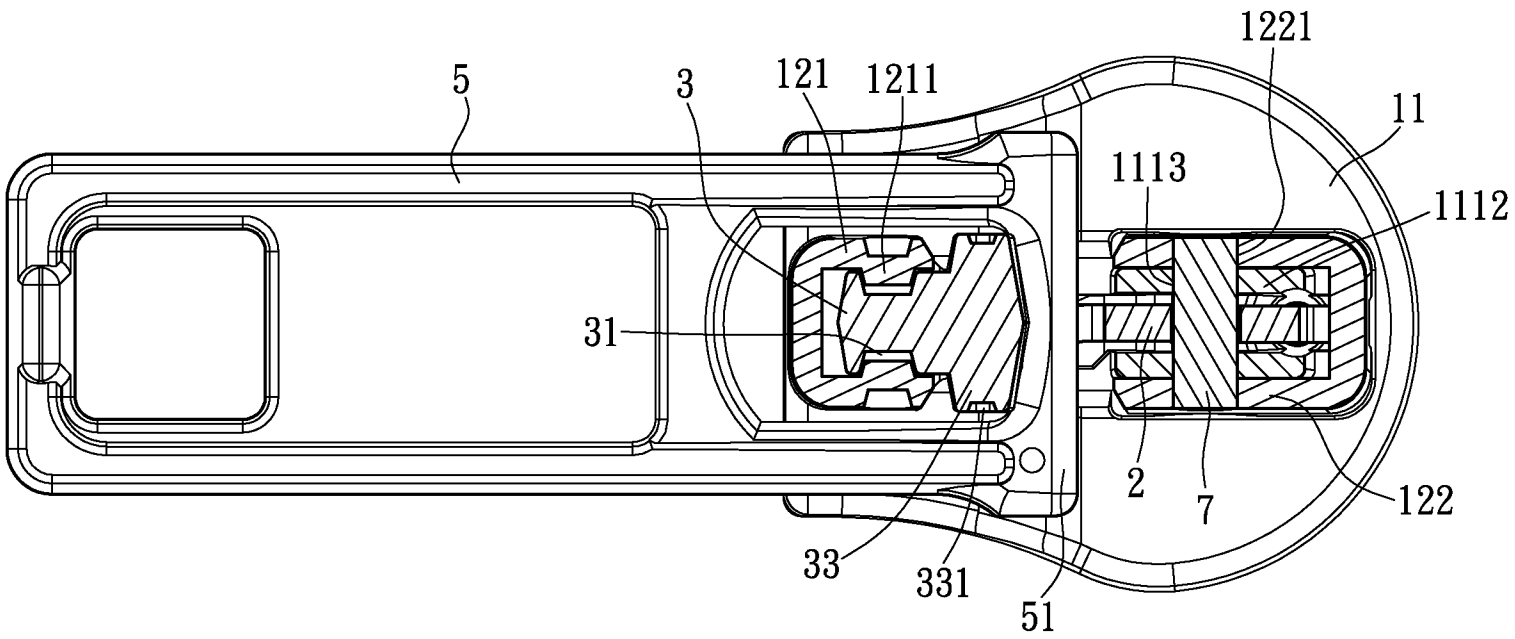
FIG. 4 shows a cross-sectional diagram of a zipper head structure with a replaceable pull tab of the present disclosure (2)

Referring to FIG. 2 and FIG. 3, the zipper head 11 has an upper board 111, a lower board 112, and a connection portion 113 connecting the upper board 111 and the lower board 112. The upper board 111, the lower board 112 and the connection portion 113 are integrally formed as one body. The connection portion 113 has a first groove 1131 within and a first fixing portion 1132. The upper board 111 has a second groove 1111. The first groove 1131 and the second groove 1111 are interconnected at the surface of the upper board 111. The first groove 1131 houses the flexible member 6. Two clips 1112 are disposed at the interconnection between the first groove 1131 and the second groove 1111. Each of the two clips 1112 has a first hole 1113. The first fixing portion 1132 is actually a protrusion between the two clips 1112. The upper board 111 and the lower board 112 form a guiding groove 114 therebetween. The guiding groove 114 can engage with a teeth chain (omitted in the figure).

Referring to FIG. 2 to FIG. 5A, the shape of the crown 12 is similar to a telephone receiver, having a front end 121 and a rear end 122, and a hollow interior connected to the outside of the crown 12. Two sides of the front end 121 each form a protrusion portion 1211 facing inward. Two sides of the rear end 122 each have a second hole 1221. Two edges of the rear end 122 have a first retaining point 1222 and a second retaining point 1223. The inner side of the crown 12 has a first protruding block 123 and two second protruding blocks 124. The rear end 122 of the crown 12 is arranged around the two clips 1112. The first holes 1113 of the clips 1112 correspond to the second holes 1221 of the crown 12. When the crown 12 and the zipper head 11 are integrated, the rear end 122 of the crown 12 abuts and is limited by the extension around the first groove 1131 on the upper board 111.

The securing member 2 is roughly branch shaped having three branches. The three branches are respectively a pivot base 21, a hook portion 22 and a latch portion 23. The lower side of the pivot base 21 has a concave second fixing portion 211 corresponding to the first fixing portion 1132. A stop hook 212 extends away from the pivot base 21. The securing member 2 is inserted into the upper board 111 of the zipper head 11. The hook portion 22 extends into the second groove 1111. The pivot base 21 presses against the flexible member 6. The pivot base 21, the first holes 1113 of the clips 1112 and the second holes 1221 of the crown 12 correspond to each other such that a shaft 7 can pass through to pivotally connect the first holes 1113, the second holes 1221 and the pivot base 21. It is worth noting that, since the crown 12 is pressed against the upper board 111, only the securing member 2 can rotate about the shaft 7. When the securing member 2 is in static equilibrium, the stop hook 212 abuts the second retaining point 1223, the convex edge on the upper part of the pivot base 21 abuts the first retaining point 1222, the bottom part of the pivot base abuts the flexible member 6, and the second fixing portion 211 abuts the first fixing portion 1132. However, when the securing member 2 is driven by an external force (e.g. the user pulls on the zipper), the securing member 2 can flip upward and press against the flexible member 6. When the external force abates, the flexible member 6 restores the securing member 2 to its original position.

The guiding member 3 is a specially designed piece that allows the present disclosure to replace pull tabs 5. Two sides on one end of the guiding member 3 each have an recessed portion 31 for pivoting with the protrusion portion 1211 of the crown 12. The shape of the guiding member 3 gradually tapers inward from the periphery of the recessed portion 31. The guiding member 3 has a slanted face and a level face. The slanted face has a sliding groove 32. The other end of the guiding member 3 opposite to the recessed portions 31 has a fin 33 on each of the two sides. The two fins 33 each have a holding hole 331 for adjusting the guiding member 3 when replacing the pull tab 5. The two recessed portions 31 are pivotally connected to the protrusion portions 1211 such that the operator can rotate the guiding member 3 by applying force on the holding hole 331 (can insert a pin shaped object into the holding hole 331) when replacing the pull tab 5. The sliding groove 32 and the latch portion 23 of the securing member 2 match each other such that the latch portion 23 can move along the sliding groove 32 as the securing member 2 rotates. In normal use of the zipper, regardless of which direction the user pulls on the pull tab 5, the guiding member 3 closes upon the gap between the zipper head 11 and the crown 12 to ensure that the pull tab 5 does not become detached.

Figure 5A:
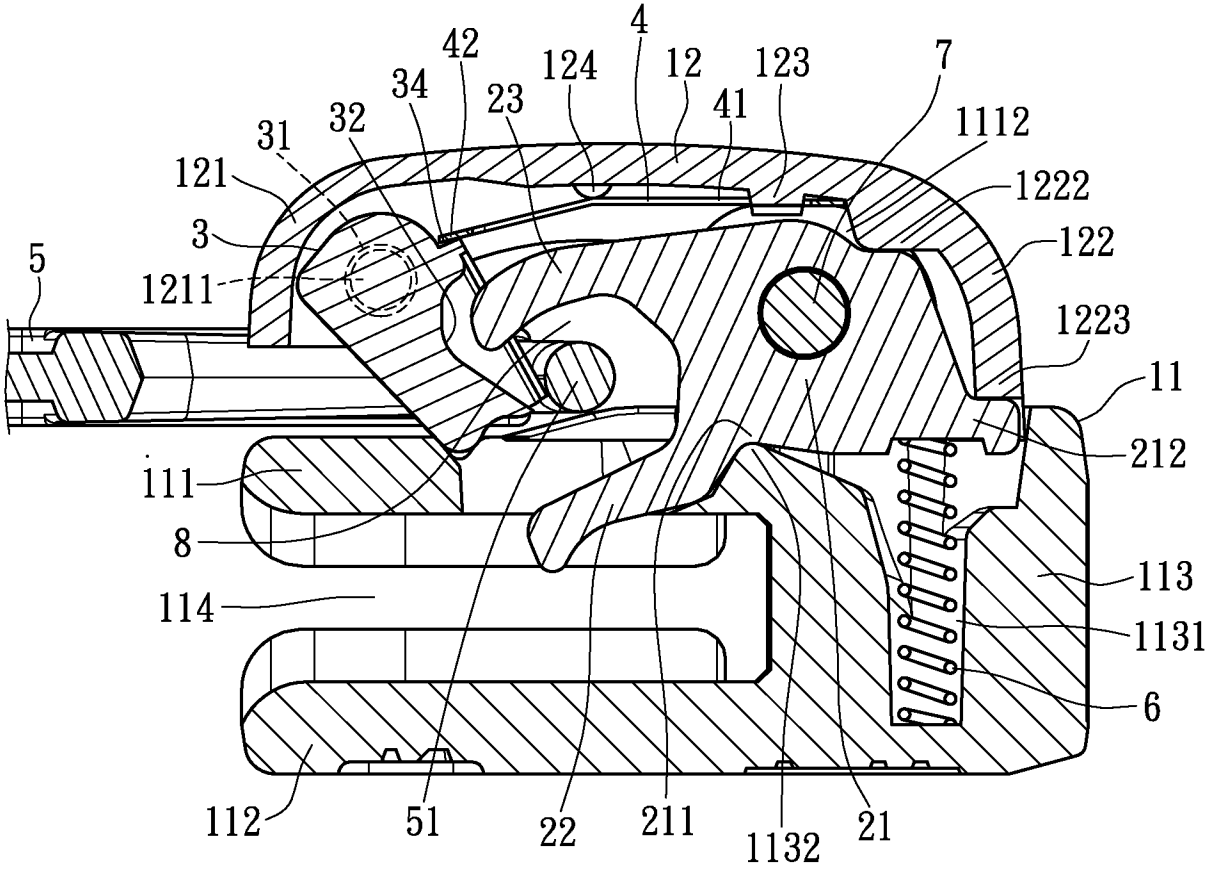
FIG. 5A shows a operation diagram of a zipper head structure with a replaceable pull tab of the present disclosure (1)

Referring to FIG. 2 and FIG. 5A, the blocking piece 4 is disposed within the hollow portion of the crown 12, and has a first bend 41, a second bend 42 and an opening 43. The first bend 41 abuts the top part of the clip 1112. The second bend 42 abuts an abutting face 34 of the guiding member 3. One end of the opening 43 is disposed around the first protruding block 123 of the crown 12. The two second protruding blocks 124 abut the turning point between the first bend 41 and the second bend 42. The first bend 41 and the second bend 42 bends at an angle toward the direction of the zipper head 11. This angle allows the blocking piece 4 to resist unintentional movement of the guiding member 3 (e.g. pushing by water flow during washing). The size of the opening 43 can coincide with the latch portion 23 of the securing member 2. Therefore, when the pivot base 21 of the securing member 2 rotates about the shaft 7, the latch portion 23 can pass through the blocking piece 4 without being blocked.

Figure 5B:
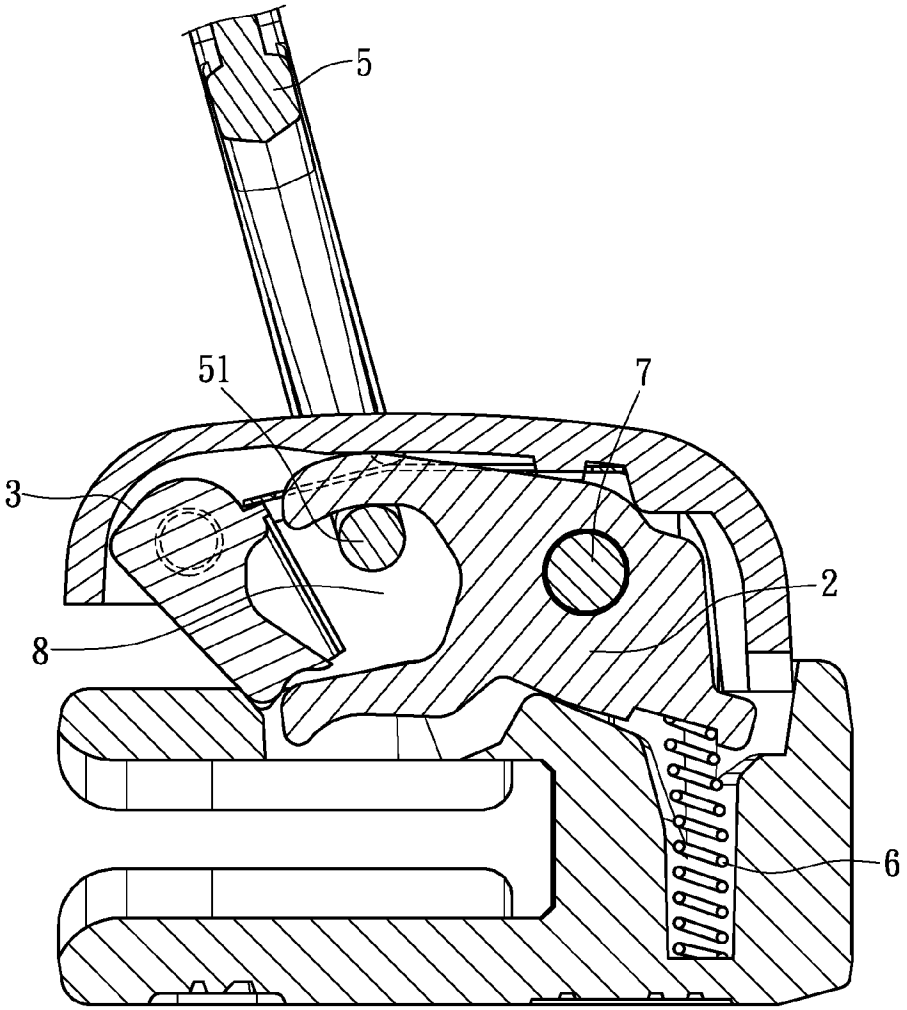
FIG. 5B shows a operation diagram of a zipper head structure with a replaceable pull tab of the present disclosure (2)
Figure 5C:
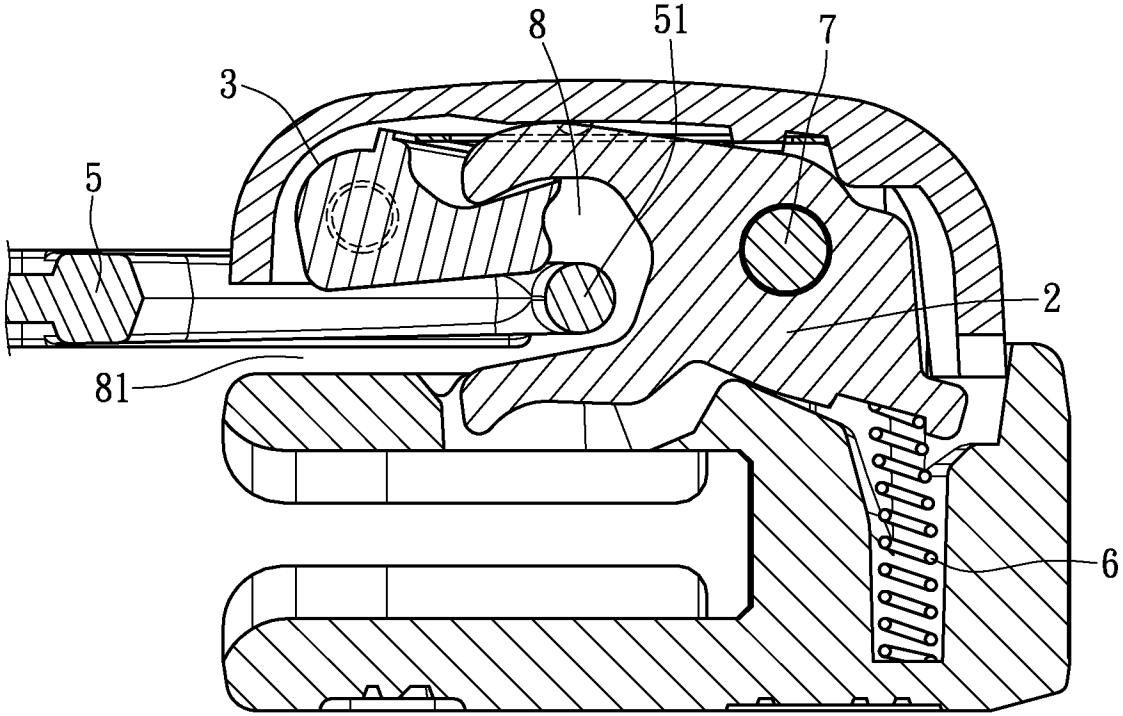
FIG. 5C shows a operation diagram of a zipper head structure with a replaceable pull tab of the present disclosure (3)
Figure 6:
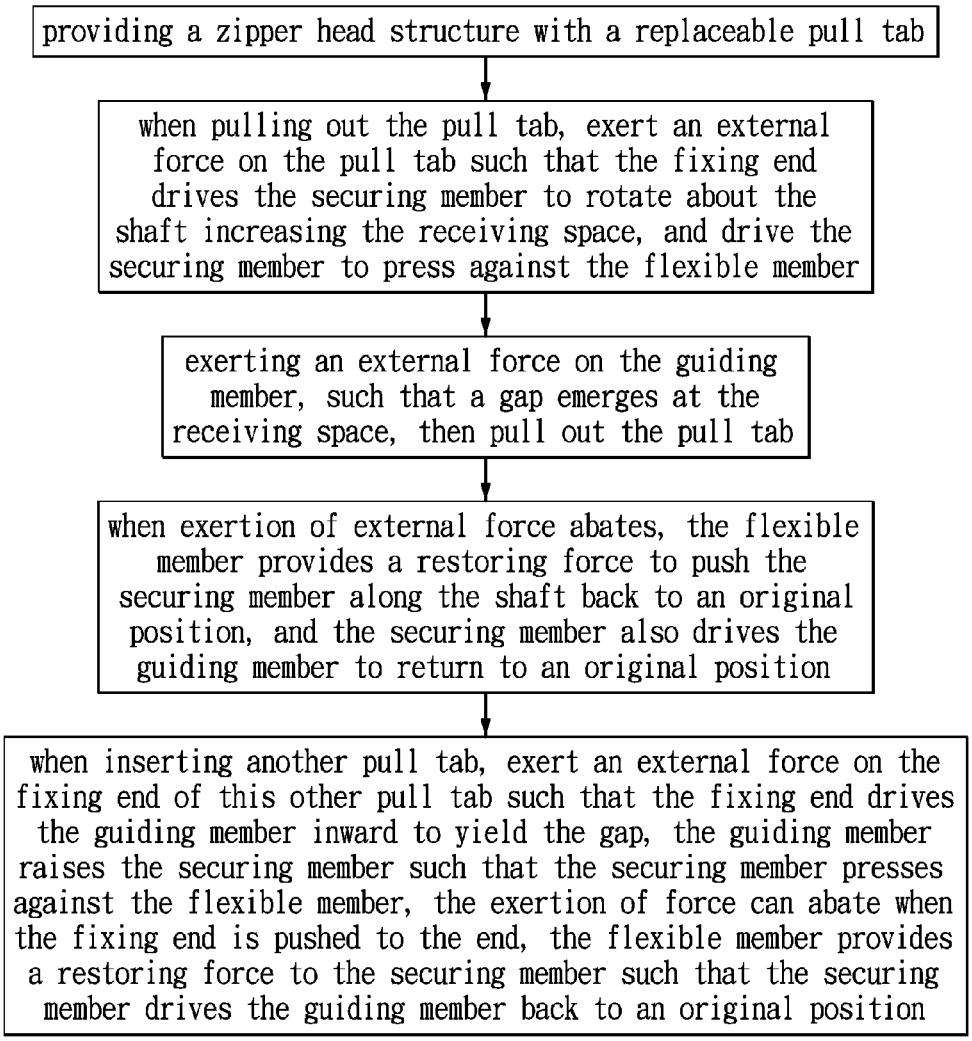
FIG. 6 shows a flowchart of a pull tab replacement method of the present disclosure.

Referring to FIG. 5A to FIG. 5C, the zipper head 11, the securing member 2 and the guiding member 3 define a receiving space 8. The pull tab 5 can have different patterns printed on its surface (omitted in the figure) and has a fixing end 51. The fixing end 51 is disposed within the receiving space 8. When the securing member 2 or the guiding member 3 is subject to force and rotates, the receiving space 8 accommodating the fixing end 51 changes shape accordingly. When a gap 81 emerges at the receiving space 8, the operator can withdraw or insert pull tabs 5.

The present disclosure provides a pull tab replacement method for a zipper head structure with a replaceable pull tab, including the following steps: referring to FIG. 5A, provide the mentioned zipper head structure with a replaceable pull tab; referring to FIG. 5B, when the pull tab 5 is to be pulled out, apply an external force on the pull tab 5 such that the fixing end 51 drives the securing member 2 to rotate about the shaft 7 and increase the receiving space 8 and press against the flexible member 6; referring to FIG. 5C, then apply another external force on the guiding member 3 such that the guiding member 3 yields a gap 81 to the receiving space 8, and the pull tab 5 is pulled out; stop applying force, and the flexible member 6 provides a restoring force to drive the securing member 2 to rotate about the shaft 7 back to the original position, and the securing member 2 in turn drives the guiding member 3 to move back to the original position; and when another pull tab 5 is to be inserted, apply an external force at the fixing end 51 of this pull tab 5 such that the fixing end 51 pushes the guiding member 3 inward to yield the gap 81, and the guiding member 3 raises the securing member 2 and makes the securing member 2 press against the flexible member 6; when the fixing end 51 is pushed to an end, stop applying force, the flexible member 6 then provides a restoring force on the securing member 2 such that the securing member 2 drives the guiding member 3 back to the original position.

In general, the special feature of the present disclosure lies in the design of the guiding member, which allows the operator to open a gap on the zipper head with simple tools, for removal and insertion of pull tabs. The procedure is convenient, and the assembly does not require a new machine, thereby reducing the manufacturing cost and raising efficiency. Additionally, the blocking piece prevents the guiding member from yielding the gap during washing and letting the pull tab fall out.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A zipper head structure with a replaceable pull tab, comprising:

a main structure, having a first fixing portion;

a flexible member, disposed within the main structure;

a securing member, having a second fixing portion corresponding to the first fixing portion, disposed in the main structure and abutting the flexible member;

a replaceable pull tab, having a fixing end;

a guiding member, pivotally connected to one end of the main structure, wherein the guiding member and the securing member abut each other, the main structure, the securing member, and the guiding member define a receiving space there-between, and the fixing end is disposed in the receiving space; and a shaft, passing through the main structure and pivotally connected to the securing member, wherein the securing member, the guiding member and the pull tab are arranged, such that when an external force is exerted on the pull tab, the pull tab drives the securing member to rotate and increase the receiving space, and when another external force is exerted on the guiding member, a gap emerges from the receiving space, and the gap allows extraction of the pull tab.

2. The zipper head structure according to claim 1, wherein the main structure comprises a zipper head and a crown, the zipper head has a first groove and a second groove, the first groove and the second groove are interconnected at the surface of the zipper head, the crown has a blocking piece therewithin, the blocking piece abuts the guiding member and the zipper head, the securing member has a pivot base, and the pivot base pivots about the shaft and abuts the flexible member.

3. The zipper head structure according to claim 2, wherein the crown has a first protruding block and two second protruding blocks, the blocking piece has a first bend, a second bend, and an opening corresponding to the securing member, the first bend abuts the zipper head, the second bend abuts the guiding member, an end of the opening is disposed around the first protruding block, the two second protruding blocks abut the turning point between the first bend and the second bend.

4. The zipper head structure according to claim 2, wherein the flexible member is disposed in the first groove, the pivot base has a hook portion, and the hook portion extends downward into the second groove.

5. The zipper head structure according to claim 4, wherein the pivot base has a latch portion, and the latch portion extends upward and abuts the guiding member.

6. The zipper head structure according to claim 5, wherein the zipper head has two clips on one end, the two clips each have a first hole, two sides on one end of the crown each have a second hole, and the shaft passes through the two first holes and the two second holes.

7. The zipper head structure according to claim 5, wherein the guiding member has a sliding groove and an abutting face, the latch portion is in contact with the sliding groove, and the blocking piece abuts the abutting face.

8. The zipper head structure according to claim 2, wherein the pivot base has a stop hook extending outward, the crown has a first retaining point for abutting the pivot base and a second retaining point for abutting the stop hook, and the first fixing portion, the first retaining point and the second retaining point jointly hold the securing member in place.

9. The zipper head structure according to claim 1, wherein the first fixing portion is a convex portion, and the second fixing portion is a concave portion.

10. A pull tab replacement method, comprising the following steps:

providing a zipper head structure, comprising a main structure, a flexible member, a securing member, a replaceable pull tab, a guiding member and a shaft, wherein the main structure has a first fixing portion, the flexible member is disposed within the main structure, the securing member has a second fixing portion corresponding to the first fixing portion, the securing member is inserted in the main structure and abuts the flexible member, the pull tab has a fixing end, the guiding member is pivotally connected to one end of the main structure, the guiding member and the securing member abut each other, the main structure, the securing member and the guiding member define a receiving space, the fixing end is disposed within the receiving space, the shaft passes through the main structure and is pivotally connected to the securing member;

exerting an external force on the pull tab such that the fixing end drives the securing member to rotate about the shaft and increase the receiving space when pulling out the pull tab, and drive the securing member to press against the flexible member;

exerting another external force on the guiding member such that a gap emerges from the receiving space then the extraction of the pull tab;

providing a restoring force by the flexible member to push the securing member about the shaft back to an original position when exertion of the external force abates, and the securing member also drives the guiding member to return to an original position; and exerting an external force on a fixing end of another pull tab such that the fixing end drives the guiding member inward to yield the gap, the guiding member raises the securing member such that the securing member presses against the flexible member, the exertion of force abates when the fixing end abuts the securing member, the flexible member provides a restoring force to the securing member such that the securing member drives the guiding member back to the original position.

11. The pull tab replacement method according to claim 10, wherein the main structure comprises a zipper head and a crown, the zipper head has a first groove and a second groove, the first groove and the second groove are interconnected at the surface of the zipper head, the crown has a blocking piece therewithin, the blocking piece abuts the guiding member and the zipper head, the securing member has a pivot base, and the pivot base pivots about the shaft and abuts the flexible member.

12. The pull tab replacement method according to claim 11, wherein the crown has a first protruding block and two second protruding blocks, the blocking piece has a first bend, a second bend, and an opening corresponding to the securing member, the first bend abuts the zipper head, the second bend abuts the guiding member, one end of the opening is disposed around the first protruding block, the two second protruding blocks abut the turning point between the first bend and the second bend.

13. The pull tab replacement method according to claim 11, wherein the flexible member is disposed in the first groove, the pivot base has a hook portion, and the hook portion extends into the second groove.

14. The pull tab replacement method according to claim 13, wherein the pivot base has a latch portion, and the latch portion abuts the guiding member.

15. The pull tab replacement method according to claim 14, wherein the zipper head has two clips on one end, the two clips each have a first hole, two sides on one end of the crown each have a second hole, and the shaft passes through the two first holes and the two second holes.

16. The pull tab replacement method according to claim 14, wherein the guiding member has a sliding groove and an abutting face, the latch portion is in contact with the sliding groove, and the blocking piece abuts the abutting face.

17. The pull tab replacement method according to claim 11, wherein the pivot base has a stop hook extending outward, the crown has a first retaining point for abutting the pivot base and a second retaining point for abutting the stop hook, and the first fixing portion, the first retaining point and the second retaining point jointly hold the securing member in place.

18. The pull tab replacement method according to claim 10, wherein the first fixing portion is a convex portion, and the second fixing portion is a concave portion.

19. A zipper head structure, comprising:

a main structure, having a first fixing portion;

a flexible member, disposed within the main structure;

a securing member, having a second fixing portion corresponding to the first fixing portion, disposed in the main structure and abutting the flexible member;

a replaceable pull tab, having a fixing end;

a guiding member, pivotally connected to one end of the main structure, wherein the guiding member and the securing member abut each other, the main structure, the securing member, and the guiding member define a receiving space there-between, and the fixing end is disposed in the receiving space; and a shaft, passing through the main structure and pivotally connected to the securing member, wherein the main structure comprises a zipper head and a crown, the zipper head has a first groove and a second groove, the first groove and the second groove are interconnected at the surface of the zipper head, the crown has a blocking piece therewithin, the blocking piece abuts the guiding member and the zipper head, the securing member has a pivot base, and the pivot base pivots about the shaft and abuts the flexible member.

* * * * *